US012129536B2

(12) United States Patent
Buck

(10) Patent No.: US 12,129,536 B2
(45) Date of Patent: Oct. 29, 2024

(54) STRONG, TOUGH, AND HARD STAINLESS STEEL AND ARTICLE MADE THEREFROM

(71) Applicant: CRS HOLDINGS, INC., Wilmington, DE (US)

(72) Inventor: Robert F. Buck, Level Green, PA (US)

(73) Assignee: CRS HOLDINGS, LLC, Wilmington, DE (US)

( * ) Notice: Subject to any disclaimer, the term of this patent is extended or adjusted under 35 U.S.C. 154(b) by 0 days.

(21) Appl. No.: 17/325,583

(22) Filed: May 20, 2021

(65) Prior Publication Data

US 2021/0363621 A1 Nov. 25, 2021

Related U.S. Application Data

(60) Provisional application No. 63/028,608, filed on May 22, 2020.

(51) Int. Cl.
*C22C 38/00* (2006.01)
*C21D 8/00* (2006.01)
(Continued)

(52) U.S. Cl.
CPC ..... *C22C 38/42* (2013.01); *C21D 8/005* (2013.01); *C22C 38/001* (2013.01);
(Continued)

(58) Field of Classification Search
None
See application file for complete search history.

(56) References Cited

U.S. PATENT DOCUMENTS 5,310,431 A 5/1994 Buck
6,890,393 B2 5/2005 Buck
(Continued)

FOREIGN PATENT DOCUMENTS

CN 108251759 A 7/2018
EP 1158065 A1 11/2001
(Continued)

OTHER PUBLICATIONS

Latrobe Specialty Steel Company Data Sheet, Lescalloy BG42 VIM-VAR, High Performance Bearing Steel AMS 5749, 2007, 4 pages.
(Continued)

*Primary Examiner* — Kim S. Horger
(74) *Attorney, Agent, or Firm* — Dann, Dorfman, Herrell and killman, P.C.

(57) ABSTRACT

An iron-base, fine-grained, martensitic stainless steel alloy is disclosed. The alloy is essentially free of delta ferrite and provides very high hardness and good corrosion resistance. The alloy consists essentially of the following composition in weight percent.

C about 0.20 to about 0.70
Mn about 5 max.
Si about 1 max.
P about 0.1 max.
S about 0.03 max.
Cr about 7.5 to about 15
Ni about 2 to about 5
Mo about 4 max.
Co about 4 max.
Cu about 1.2 max.
Ti about 0.01 to about 0.75
Al about 0.2 max
Nb about 1 max.
about 2 max.
N about 0.02 max.
B about 0.1 max.

The balance of the alloy is iron and the usual impurities. A composite article of manufacture is also disclosed that includes a case portion formed of the foregoing alloy.

7 Claims, 5 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(56) References Cited

U.S. PATENT DOCUMENTS

| | | | | |
|---|---|---|---|---|
| 6,899,773 | B2 | 5/2005 | Buck | |
| 7,470,336 | B2 | 12/2008 | Buck | |
| 2004/0096351 | A1* | 5/2004 | Suzuki | C21D 8/005 420/60 |
| 2009/0196784 | A1 | 8/2009 | Fedchun et al. | |
| 2011/0024003 | A1 | 2/2011 | Vartanov | |
| 2012/0255653 | A1 | 10/2012 | Chin et al. | |
| 2013/0032251 | A1 | 2/2013 | Chin et al. | |
| 2014/0140883 | A1 | 5/2014 | Wert | |
| 2015/0284817 | A1 | 10/2015 | Snyder et al. | |
| 2017/0016084 | A1 | 1/2017 | Chin et al. | |

FOREIGN PATENT DOCUMENTS

| | | | |
|---|---|---|---|
| EP | 1602744 | A1 | 7/2005 |
| JP | 2004190658 | A | 7/2004 |
| WO | 2006038878 | A1 | 4/2006 |
| WO | 2014066570 | A1 | 5/2015 |

OTHER PUBLICATIONS

Cao Pengjun et al., "Metal Material Science," Metallurgical Industry Press, Nov. 30, 2018, p. 46.

Zhang Mingzhi et al., "Zhuzaocidian," China Agricultural Machinery Press, Apr. 30, 1986, p. 339.

* cited by examiner

STRONG, TOUGH, AND HARD STAINLESS STEEL AND ARTICLE MADE THEREFROM

CROSS REFERENCE TO RELATED APPLICATION

This application claims the benefit of Provisional Patent Application No. 63/028,608, filed May 22, 2020, the entirety of which is incorporated herein by reference.

BACKGROUND OF THE INVENTION

Field of the Invention

This invention relates to an iron-base, fine-grained, martensitic stainless steel that is made using a thermal-mechanical treatment (TMT) to precipitate a relatively uniform dispersion of fine, coarsening-resistant, MX-type precipitates, and then hardened by diffusing carbon into the steel.

Description of the Related Art

A need exists for a strong, tough, and hard, stainless steel in the aerospace, defense, energy, medical, transportation, consumer, and industrial markets. Specific applications that could benefit from such an alloy include, among others, bearings, gears, actuators, cutlery, pump components, shafts, gun barrels, bolts, bolt carriers, valves, and dies. Conventional carburizable stainless steels, such as PYROWEAR® 675 and CX13VDW provide high hardness, but do not exhibit good corrosion resistance after heat treatment, which can be cumbersome. Conventional through-hardening stainless steels, such as AISI Type 440C and the BG42 alloy also provide high hardness, but do not offer good corrosion resistance after heat treatment. Moreover, they provide relatively low impact toughness. The CRONIDUR® 30 alloy has good corrosion resistance, but cannot achieve a hardness greater than 60 Rockwell C hardness (Rc). The alloy also suffers from very low impact toughness. In view of the foregoing, there is no existing air-melted or vacuum melted steel material that offers the following combination of properties: (i) high surface (case) hardness (i.e., greater than 58-60 Rc), (ii) deep effective case depth (i.e., greater than 0.040 in.), (iii) good corrosion resistance after exposure to an aggressive corrosion environment such as ASTM B117 (salt fog corrosion test), (iv) high yield strength (i.e., greater than 135 ksi); (v) high ultimate tensile strength (i.e., greater than 170 ksi), (vi) good tensile elongation (i.e., greater than 8%), (vii) high Charpy V-notch impact toughness (i.e., greater than 30 ft-lb), and (viii) high fracture toughness (i.e., greater than 80 ksi $\sqrt{in}$). A secondary objective is that the aforementioned properties be provided after the alloy material has been tempered at a temperature of at least about 300° F. which is important for certain aerospace applications.

It is well known in ferrous metallurgy that to increase hardness it is generally necessary to increase the carbon content of a steel alloy. Similarly, to increase corrosion resistance it is generally necessary to increase the chromium content of a steel alloy. However, a problem arises when it is desired to increase both hardness and corrosion resistance in the same steel alloy. Through-hardening stainless steels such as AISI Type 440C and the BG42 alloy attempt to achieve high hardness and good corrosion resistance by adding large quantities of both carbon and chromium (e.g., nominally about 1% C and 17% Cr in 440C, and about 1.15% C and 14.5% Cr in the BG42 alloy). The 440C alloy can be hardened to a peak hardness of about 59 Rc, while the BG42 alloy can be hardened to about 61 Rc after heat treatment. However, in making such alloys, a large volume fraction of chromium-rich particles (e.g., $M_7X_3$ and/or $M_{23}X_6$) precipitate in the alloy thereby depleting the alloy matrix of chromium which is necessary for corrosion resistance. Persons skilled in the art will understand that the "M" in $M_aX_b$ refers to a metal atom or atoms, such as iron and/or chromium, and that the "X" generally refers to carbon, but could also refer to nitrogen. The precipitation of deleterious chromium-rich carbide, nitride, and/or carbonitride particles occurs when the through-hardening stainless steels are exposed to temperatures commonly used for hot working and during subsequent heat treating. This results in the formation of chromium-depleted zones surrounding the chromium-rich carbide/nitride precipitates which in turn results in compromised corrosion resistance in the alloy matrix material. If the local chromium content of the chromium-depleted regions falls below about 10.5% Cr, the steel is no longer considered to be "stainless", and rusting may occur after exposure to normal atmospheric conditions, and especially after exposure to aggressive conditions (e.g., salt fog). It is important to note that the phenomenon described above is not limited to the through-hardened stainless steels mentioned above. It also affects the family of through-hardened stainless steels, including, but not limited to, other known martensitic stainless steels such as AISI grades 440A, 440B, and 420 to various degrees. Note that these other martensitic stainless steels generally cannot be hardened to the high hardness levels (i.e., greater than 58-60 Rc) desired in many applications and industries.

There is a category of stainless steels known as carburizing stainless steels, (e.g., PYROWEAR® 675 alloy and CX13VDW alloy) which generally contain about 12-13% Cr and relatively low carbon (<0.15%). When such steels are carburized, typically at 1600° F. to 1750° F., the amount of carbon that diffuses into the steel exceeds the solubility limit of carbon in the respective alloy at the diffusion temperature. The process results in precipitation of massive amounts of large, inter- and intragranular, chromium-rich carbides, thereby depleting the surrounding iron matrix of chromium. Because the hardness of the chromium-rich particles is very high, and the carburization process results in a large volume fraction of such particles, the overall hardness of the carburized case can be high, e.g., 61 Rc to 63 Rc, or higher. However, the chromium-rich carbides necessary for the high hardness are retained in the case microstructure even after subsequent conventional heat treatment, thereby causing the surrounding matrix to be depleted of chromium. As mentioned previously, when the matrix chromium content falls to a level that is less than about 10.5% Cr, the steel is no longer considered to be "stainless" and is more susceptible to corrosive attack. Regardless of post-carburizing heat treatment, the large volume fraction of chromium-rich precipitates in the case that forms during carburization is not eradicated from the microstructures. As a result, the "stainless" carburizing steels suffer essentially the same effects as conventional through-hardened stainless steels, namely, relatively poor corrosion resistance after heat treatment compared to other stainless steels with much lower surface hardness values.

Nitrogen-augmented stainless steels, such as the CRONIDUR® 30 alloy may provide greater corrosion resistance compared to both through-hardened stainless steels such as Type 440C and carburizing stainless steels such as the PYROWEAR® 675 alloy, primarily because nitrogen is substituted for carbon, which benefits the corrosion resistance properties. However, nitrogen-augmented stainless steels generally cannot be hardened to levels greater than about 59 Rc. Moreover, they can have relatively low Charpy V-notch impact toughness. For example, the CRONIDUR 30 alloy is brittle and exhibits impact toughness of only about 1.5 ft.-lb.

In view of the foregoing discussion of the state of art, there is a need for a steel alloy that provides very high hardness without sacrificing good corrosion resistance. In addition, there is also a need for a material that provides such levels of hardness and corrosion resistance in combination with good toughness.

SUMMARY OF THE INVENTION

In accordance with one aspect of this invention there is provided an iron-base, fine-grained, martensitic stainless steel that is essentially free of delta ferrite and that provides very high hardness and good corrosion resistance. The alloy consists essentially of the following composition in weight percent.

C about 0.20 to about 0.70
Mn about 5 max.
Si about 1 max.
P about 0.1 max.
S about 0.03 max.
Cr about 7.5 to about 15
Ni about 2 to about 5
Mo about 4 max.
Co about 4 max.
Cu about 1.2 max.
Ti about 0.01 to about 0.75
Al about 0.2 max
Nb about 1 max.
about 2 max.
N about 0.02 max.
B about 0.1 max.

The balance of the alloy is iron and the usual impurities found in martensitic stainless steel alloys intended for similar applications. The alloy optionally contains Zr, Ta, and Hf provided that the sum 1.17×% Ti+0.62×% Zr+0.31×% Ta+0.31×% Hf is about 0.135% to about 1%.

In accordance with another aspect of the invention there is provided a composite article of manufacture that comprises a hard case or surface layer that consists essentially of the martensitic, stainless steel alloy described above and a tough core encompassed by the hard case.

The core material consists essentially of an alloy having the following weight percent composition.

C about 0.05 to about 0.15
Mn about 5 max.
Si about 1.5 max.
P about 0.1 max.
S about 0.03 max.
Cr about 7.5 to about 15
Ni about 1 to about 5
Mo about 4 max.
Co about 10 max.
Cu about 5 max.
Ti about 0.01 to about 0.75
Al about 0.2 max
Nb about 1 max.
about 2 max.
N about 0.02 max.
B about 0.1 max.

The balance of the core alloy is iron and the usual impurities. The tough core optionally contains Zr, Ta, and Hf as described above. A "tough core" article in accordance with this aspect of the invention is characterized by a hard, corrosion resistant steel case having high hardness that surrounds in whole or in part a core that is characterized by good strength as well as better toughness and ductility than the case material.

In accordance with a further aspect of the present invention there is provided a through-hardened, thin-gauge article made from the first alloy described above. In the through-hardened article according to this aspect, the hardened region extends throughout, or substantially throughout, the length and cross section of the article. For through-hardened parts, the steel exhibits high hardness and high strength throughout the thickness, but the impact toughness of the part is lower compared to the core portion of the "tough core" embodiment.

Here and throughout this specification, the term "percent" and the symbol "%" mean weight percent or mass percent unless otherwise indicated. For purposes of this application the term "thin-gauge" means a cross-sectional thickness of up to about 0.125 inch. The term "high hardness" means a hardness of at least about 58 Rc. The term "effective case depth" means the depth at which the hardness of a surface layer of the steel alloy falls below 50 Rc. The basic and novel properties of the alloy according to the present invention include a hardness of at least about 50 Rc in combination with corrosion resistance characterized by no appearance of corrosion when the alloy is tested in accordance with ASTM Standard Test Procedure B117.

DETAILED DESCRIPTION

Figure 1:
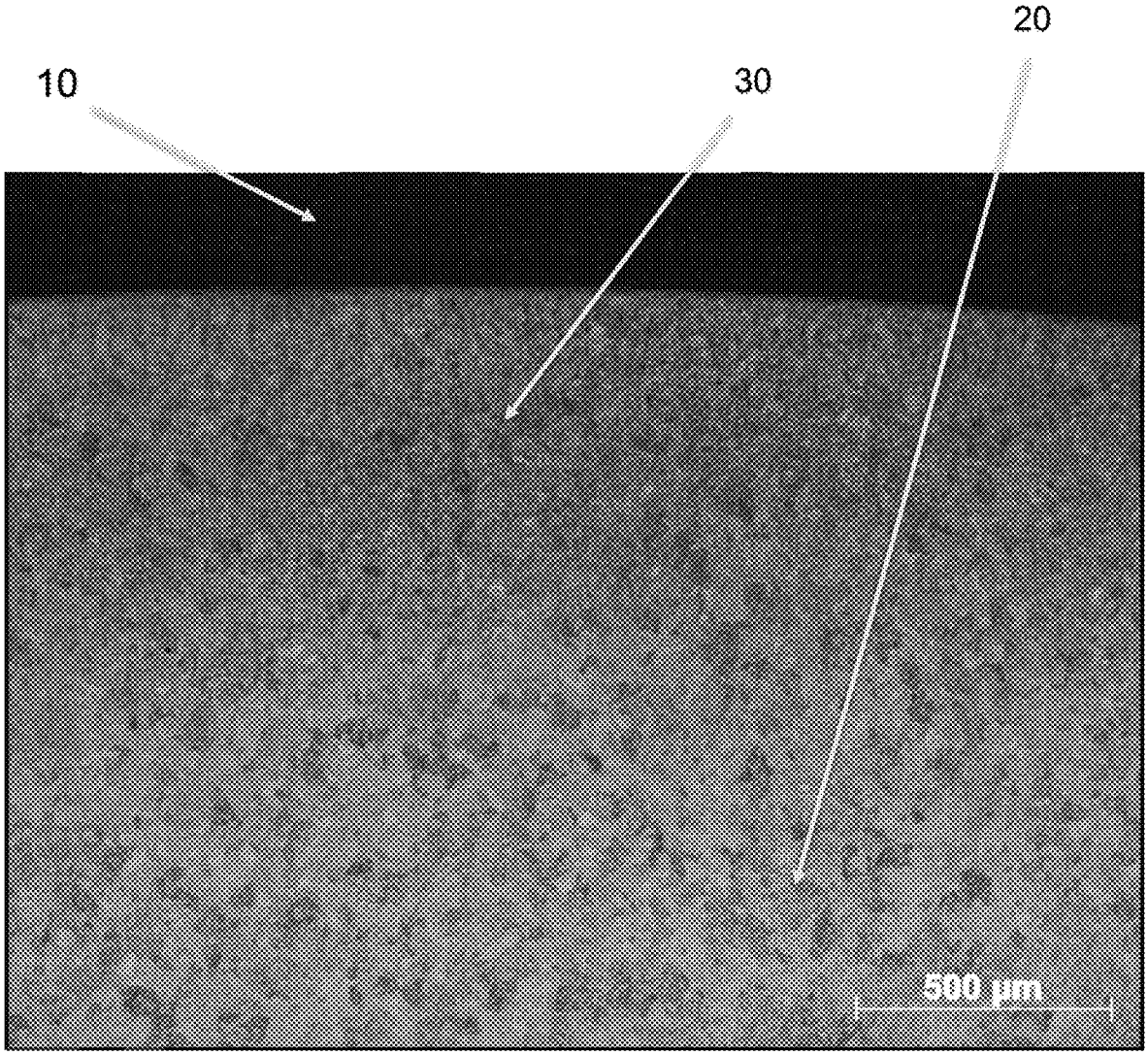
FIG. 1 is a photomicrograph of a sample of a composite article in accordance with the present invention.

The alloy and articles according to the present invention are produced from a base alloy that is described in U.S. Pat. Nos. 6,890,393 and 6,899,773, the entire disclosures of which are incorporated herein by reference. As described in the referenced patents, the known alloy is produced by using a thermal-mechanical treatment to refine the grains and precipitate a relatively uniform dispersion of fine, coarsening-resistant, MX-type precipitates. The steel alloy of the present invention incorporates the metallurgical attributes of the previously disclosed steel and includes additional carbon to achieve very high hardness and strength relative to the known steel. The additional carbon is provided by diffusing carbon into the steel in a carburizing process. After the carburizing process, the resulting alloy contains significantly more carbon in the diffused region than the base alloy.

The alloy in accordance with the present invention contains at least about 0.20% carbon to benefit the higher hardness provided by the alloy such that a hardness value of at least about 50 Rc can be provided without a significant loss of corrosion resistance. It is further noted that when the alloy contains at least about 0.30% carbon, the alloy can provide a hardness value greater than about 56 Rc. A very high hardness, i.e., greater than about 60 Rc, can be provided when the alloy contains between about 0.35% carbon and about 0.63% carbon. As carbon levels increase from about 0.63% to about 0.70%, the hardness decreases from about 60 Rc to about 50 Rc, respectively. As carbon levels continue to increase from about 0.70% to about 0.83%, the hardness continues to decrease from about 50 Rc to about 32 Rc, respectively. The reason the hardness decreases as the carbon level increases from about 0.63% to about 0.83% is that increased carbon levels stabilize greater amounts of relatively soft, retained austenite in the steel, which does not transform to hard martensite even after the as-quenched carburized alloy is subjected to cryogenic treatment. At a carbon level greater than about 0.83%, the volume fraction of hard, chromium-rich particles increases in the alloy, which gradually increases the overall hardness of the steel from about 32 Rc to about 59 Rc. However, when more than about 0.83% carbon is present in the alloy, the corrosion resistance provided by the alloy is adversely affected because the increased formation of chromium-rich particles depletes chromium from the matrix material. Preferably, the alloy contains not more than about 0.70% carbon, and for the best combination of hardness and corrosion resistance, the alloy contains not more than about 0.63% carbon.

The carbon content of the alloy according to the present invention cannot be obtained conventionally, such as by adding carbon during melting because such an alloying addition would result in a relatively large volume fraction of primary MC particles with a large interparticle spacing that would be ineffective at pinning grains during subsequent thermal mechanical treatment or hot working to result or maintain a fine grain microstructure. The preferred method for the steel of the present invention to be produced with such high carbon levels is for the carbon to be diffused into the steel after the base alloy has been thermal-mechanically processed.

The alloy according to this invention is produced by first melting and casting the base alloy described above. No special techniques are needed to melt and cast the alloy. The alloy can be melted using a conventional air melting process such as arc melting or the alloy can be vacuum melted such as by vacuum induction melting. When the alloy is air melted, it is preferred that the chemistry of the alloy be controlled such the alloy contains at least about 0.01% of aluminum and silicon combined as residual elements from deoxidizing additions during melting. The base alloy is cast into an ingot or may be cast using a continuous casting technique.

The alloy ingot or billet is subsequently processed using a thermal mechanical treatment as described in the aforesaid patents. The purpose of the thermal mechanical treatment is to recrystallize the microstructure during hot working and to precipitate a uniform dispersion of fine MX particles to pin the boundaries of the newly recrystallized grains such that a fine-grained, equiaxed microstructure is obtained after the alloy is cooled to room temperature.

The carbon is diffused into the hot-worked alloy form by a carburization process. The carburization process is carried out under conditions of temperature, time, and carbon atmosphere that are selected to provide the desired carbon content and depth of the carburized layer. After the desired amount of carbon is diffused into the hot worked steel, the steel is cryogenically treated to convert retained austenite that may have formed during the carbon diffusion process to martensite. The cryogenic treatment is carried out by chilling the alloy at about −321° F. to about −100° F. for a time selected to substantially completely transform any retained austenite to martensite. The alloy is then warmed to room temperature in air. The steel is then tempered to increase the toughness and ductility of the core and case when the article according to the invention is embodied as a composite article having a very hard, corrosion resistant case or surface layer and a strong, tough core within the case. The tempering temperature for the alloy or article according to the invention is about 200° F. to about 600° F. Tempering at higher temperatures reduces corrosion resistance, while tempering at lower temperatures reduces toughness and ductility. Preferably, the tempering temperature for the steel of the present invention or a composite article made therefrom is about 300° F. to about 400° F. It will be apparent to one skilled in the art that it is possible to temper the alloy material outside the aforesaid temperature ranges and still obtain desirable properties for a particular application. When processed as described above, a composite steel article according to the present invention can have a core hardness of about 38.5 Rc to about 41 Rc and a Charpy V-notch impact energy of about 40 to about 49 ft-lbs. in combination with a carburized case hardness of about 59 Rc to about 61 Rc.

The steel alloy of the present invention can be used as part of a composite article that is formed from the lower carbon stainless steel "base" alloy before carbon is diffused into it. The higher carbon surface layer of the composite article can extend to a depth of about 0.025 in. to about 0.100 in. The boundary can be defined as the point where the hardness of the material decreases to below about 50 Rc. FIG. 1 shows a portion of a composite article in the form of a partial cross section of a bar 10 in accordance with this embodiment. The bar 10 includes an inner core portion 20 that is characterized by high strength and good toughness. The bar 10 also has an outer case portion 30 that is characterized by very high strength and hardness. The core portion 20 and the case portion 30 are also characterized by having good corrosion resistance.

Although there are applications that require a composite article having a combination of high surface hardness, good corrosion resistance, and good core toughness and ductility (e.g., bearings and gears), there are other applications, such as knives and cutlery, that could benefit from a steel that has a combination of high hardness and good corrosion resistance throughout the part, i.e., through the cross section of the article. For such applications, another embodiment of the steel of the present invention is a thin-gauge article made from the base alloy and in which carbon has been diffused throughout, or substantially throughout, the part, thereby rendering it hard throughout, while maintaining excellent corrosion resistance. A through-hardened knife blade that utilizes the technology and methods described herein, for example, could be repeatedly sharpened without adverse consequences. This aspect of the invention has been successfully realized with thicknesses of about 0.09 inches to about 0.1 inches. However, it is believed that the invention can be extended to thicknesses up to about 0.125 inches or more.

Working Examples

In order to demonstrate the novel combination of hardness and corrosion resistance provided by the alloy according to this invention, comparative testing of an example of the alloy was carried out. More specifically, the hardness and corrosion resistance provided by the alloy of this invention was compared to samples of four known, martensitic, corrosion resistant alloys, namely, the PYROWEAR 675 alloy (Ex. A), the BG42 alloy (Ex. B), AISI Type 440C alloy (Ex. C), and the CPM S90V alloy (Ex. D) (CPM and S90V are registered trademarks). The weight percent compositions of the tested alloys are presented in the table below.

| Element | Invention | Ex. A | Ex. B | Ex. C | Ex. D |
|---|---|---|---|---|---|
| C | 0.103* | 0.07* | 1.15 | 1 | 2.30 |
| Mn | 0.43 | 0.65 | 0.5 | 0.5 | |
| Si | 0.42 | | 0.3 | 0.3 | |
| P | 0.014 | | | | |
| S | 0.0005 | | | | |
| Cr | 10.86 | 13 | 14.5 | 17 | 14.0 |
| Ni | 2.95 | 2.6 | | | |
| Mo | 0.49 | 1.8 | 4 | 0.5 | |
| Co | 0.03 | 5.4 | | | |
| Cu | 0.14 | | | | |
| Ti | 0.29 | | | | |
| Al | 0.015 | | | | |
| Nb | 0.06 | | | | |
| V | 0.10 | 0.60 | 1.2 | | 9.0 |
| N | 0.01 | | | | |
| B | 0.002 | | | | |
| Sn | 0.004 | | | | |

*Carbon concentration before carburization.

The balance of each alloy is essentially iron.

The sample of the alloy according to the invention was carburized, quenched, cryogenically treated, and them tempered as described above. The carburized case depth was about 0.055 inches. The sample of Example A was carburized and then heat treated using a known process for that alloy. The carburized case depth was about 0.040 inches. The samples of Examples B, C, and D were heat treated in accordance with the known heat treatments for those alloys. The samples of each alloy were then tested for surface hardness and corrosion resistance.

The sample of the alloy of the present invention had a measured hardness of 61 Rc. The sample of Example A had a measured hardness of 63 Rc. The measured hardness of the sample of Example B was 61 Rc. The sample of Example C had a measured hardness of 59 Rc and the sample of Example D had a measured hardness of 58 Rc.

Figure 2:
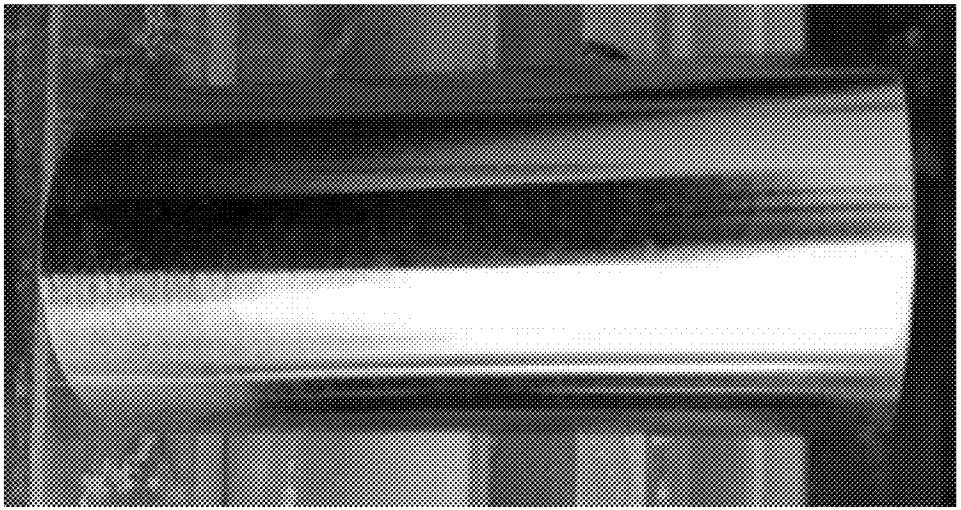
FIG. 2 is a photograph of a sample of the alloy according to the present invention after testing in accordance with ASTM Standard Test Procedure B117.
Figure 3:
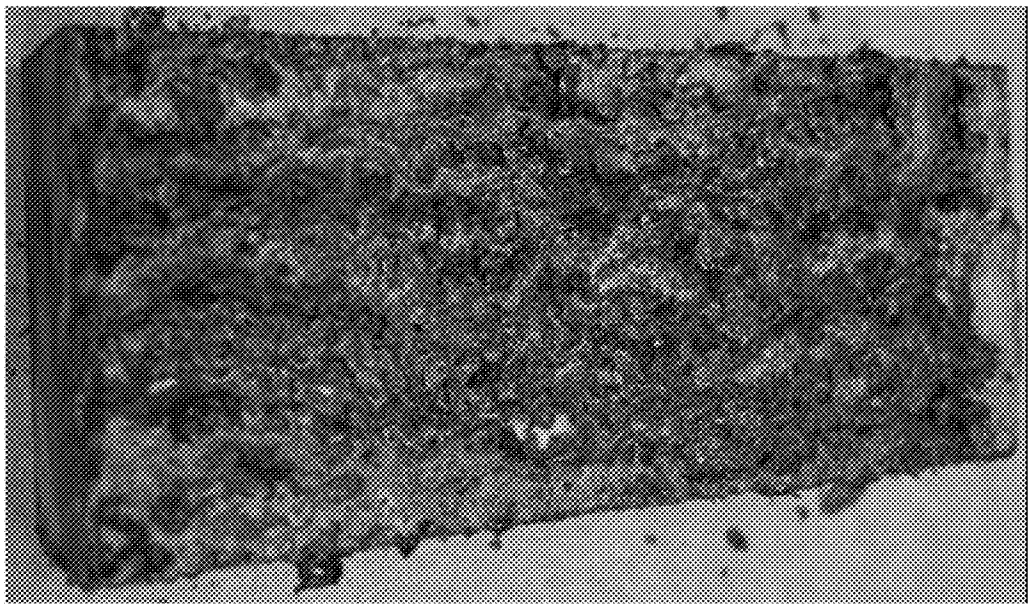
FIG. 3 is a photograph of a sample of comparative Example A after testing in accordance with ASTM Standard Test Procedure B117.
Figure 4:
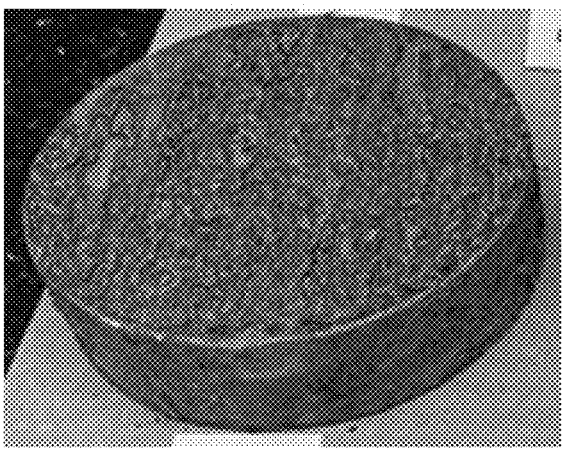
FIG. 4 is a photograph of a sample of comparative Example B after testing in accordance with ASTM Standard Test Procedure B117.
Figure 5:
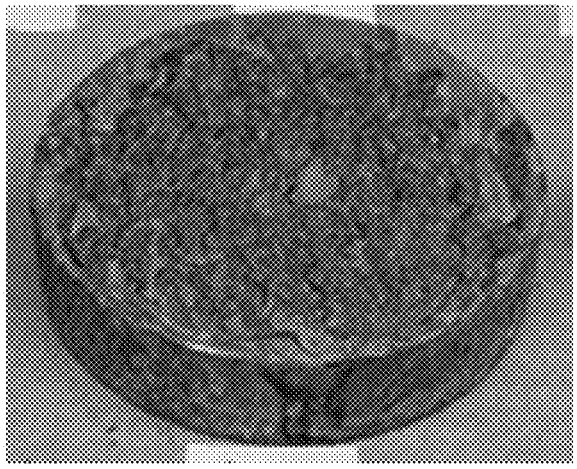
FIG. 5 is a photograph of a sample of comparative Example C after testing in accordance with ASTM Standard Test Procedure B117.
Figure 6:
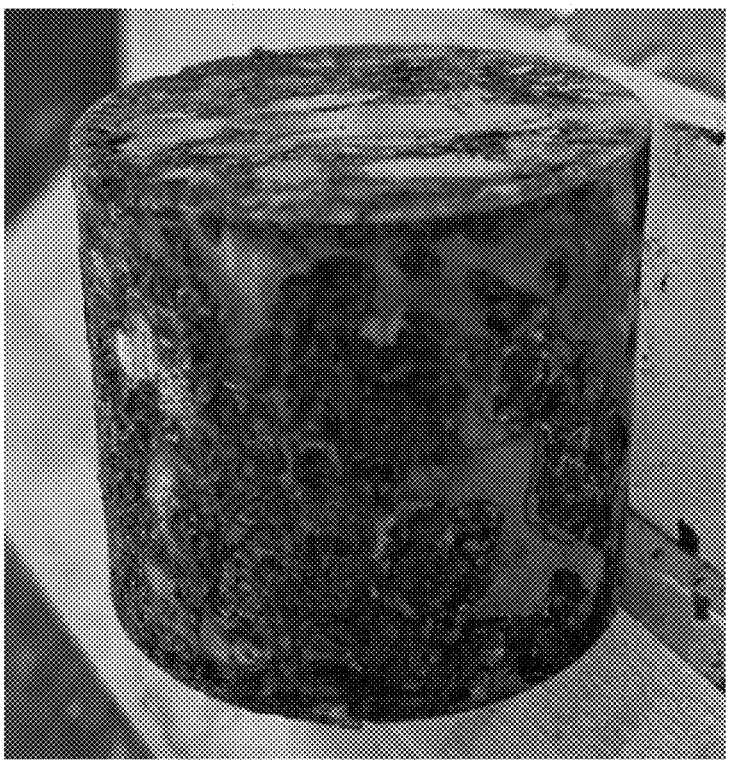
FIG. 6 is a photograph of a sample of comparative Example D after testing in accordance with ASTM Standard Test Procedure B117.

Corrosion testing was performed on samples of each alloy in accordance with ASTM Standard Test Procedure B117 (salt fog test). Shown in FIGS. 2-6 are photographs of the samples of each alloy after a 200-hour exposure to the salt fog. FIG. 2 shows the sample of the alloy according to the present invention. FIG. 3 shows the sample of comparative Example A. FIG. 4 shows the sample of comparative Example B. FIG. 5 shows the sample of comparative Example C and FIG. 6 shows the sample of comparative Example D.

The terms and expressions which are employed in this specification are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A martensitic stainless steel alloy consisting essentially of, in weight percent:

C about 0.30 to about 0.70
Mn about 5 max.
Si about 1 max.
P about 0.1 max.
S about 0.03 max.
Cr about 10.5 to about 15
Ni about 2 to about 5
Mo about 4 max.
Co about 4 max.
Cu about 1.2 max.
Ti about 0.01 to about 0.75
Al about 0.2 max
Nb about 1 max.
V about 2 max.
N about 0.02 max.
B about 0.1 max.
the balance is iron and impurities,
wherein the alloy optionally contains Zr, Ta, and Hf such that the sum 1.17×% Ti+0.62×% Zr+0.31×% Ta+0.31×% Hf is about 0.135% to about 1%; and
whereby the alloy provides a hardness of at least about 50 HRC.

2. An article of manufacture comprising a core portion and a carburized case portion that is formed on said core portion, wherein the case portion consists essentially of a martensitic stainless steel case alloy having the following composition in weight percent:

C about 0.30 to about 0.70
Mn about 5 max.
Si about 1 max.
P about 0.1 max.
S about 0.03 max.
Cr about 10.5 to about 15
Ni about 2 to about 5
Mo about 4 max.
Co about 4 max.
Cu about 1.2 max.
Ti about 0.01 to about 0.75
Al about 0.2 max
Nb about 1 max.
V about 2 max.
N about 0.02 max.
B about 0.1 max.
the balance is iron and impurities, and
the core portion consists essentially of a martensitic stainless steel core alloy having the following composition in weight percent:
C about 0.05 to about 0.15
Mn about 5 max.
Si about 1.5 max.
P about 0.1 max.
S about 0.03 max.
Cr about 7.5 to about 15
Ni about 1 to about 5
Mo about 4 max.
Co about 10 max.
Cu about 5 max.
Ti about 0.01 to about 0.75
Al about 0.2 max
Nb about 1 max.
V about 2 max
N about 0.02 max.
B about 0.1 max.

and the balance of the core alloy is iron and the impurities;

wherein the martensitic stainless steel case alloy optionally contains Zr, Ta, and Hf such that the sum 1.17×% Ti+0.62×% Zr+0.31×% Ta+0.31×% Hf is about 0.135% to about 1%.

3. The article as claimed in claim 2 wherein the article is a bar and the case portion surrounds the core portion.

4. The article as claimed in claim 3 wherein the case has an effective case depth of about 0.025 in. to about 0.100 in.

5. The article of manufacture as claimed in claim 2 wherein the article is a thin-gauge article.

6. The alloy as claimed in claim 1 which contains not more than about 13% chromium.

7. The article as claimed in claim 2 wherein the martensitic stainless steel case alloy contains not more than about 13% chromium.

* * * * *